US008416170B2

(12) United States Patent
Zhang et al.

(10) Patent No.: US 8,416,170 B2
(45) Date of Patent: Apr. 9, 2013

(54) LIQUID CRYSTAL DISPLAY

(75) Inventors: Yong Zhang, Shenzhen (CN); Liangchan Liao, Shenzhen (CN); Dongsheng Guo, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 0 days.

(21) Appl. No.: 12/997,495

(22) PCT Filed: Nov. 12, 2010

(86) PCT No.: PCT/CN2010/078698

§ 371 (c)(1), (2), (4) Date: Dec. 10, 2010

(87) PCT Pub. No.: WO2012/012984

PCT Pub. Date: Feb. 2, 2012

(65) Prior Publication Data

US 2012/0026136 A1 Feb. 2, 2012

(30) Foreign Application Priority Data

Jul. 28, 2010 (CN) ..... 2010 1 0239602

(51) Int. Cl.
*G09G 3/36* (2006.01)

(52) U.S. Cl. ..... 345/92

(58) Field of Classification Search ..... 345/87, 345/92, 96

See application file for complete search history.

(56) References Cited

U.S. PATENT DOCUMENTS

| | | | | |
|---|---|---|---|---|
| 6,075,505 | A * | 6/2000 | Shiba et al. | 345/92 |
| 6,707,441 | B1 * | 3/2004 | Hebiguchi et al. | 345/92 |
| 8,179,350 | B2 * | 5/2012 | Park et al. | 345/92 |
| 8,253,670 | B2 * | 8/2012 | Ono | 345/96 |
| 2008/0158118 | A1 | 7/2008 | Ono et al. | |

FOREIGN PATENT DOCUMENTS

| | | | |
|---|---|---|---|
| CN | 1800917 | A | 7/2006 |
| CN | 101369083 | A | 2/2009 |
| CN | 101893790 | A | 11/2010 |
| JP | 10068931 | A | 3/1998 |

* cited by examiner

*Primary Examiner* — Kevin M Nguyen

(74) *Attorney, Agent, or Firm* — Ditthavong Mori & Steiner, P.C.

(57) ABSTRACT

A liquid crystal display includes a plurality of pixel groups. At least a pixel group is surrounded by a first scan line, a second scan line, a first data line, and a second data line. Each pixel group includes a first transistor, a first subpixel, a second transistor, a second subpixel, a third transistor, a third subpixel, a fourth transistor, and a fourth subpixel. The first transistor is electrically connected with the first scan line and the first data line. The second transistor is electrically connected with the first scan line and the second data line. The third transistor is electrically connected with the second scan line and the first data line. The fourth transistor is electrically connected with the second scan line and the second data line.

13 Claims, 7 Drawing Sheets

LIQUID CRYSTAL DISPLAY

BACKGROUND OF THE INVENTION

1. Field of the Invention

The present invention relates to a liquid crystal display (LCD), and more particularly, to an LCD capable of driving pixels and realizing dot inversion without using bridge lines.

2. Description of Prior Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously.

Refer to FIG. 1, which shows a schematic diagram of a traditional LCD 10 applying a half source driver (HSD) technology. The LCD 10 comprises a pixel matrix 12, a gate driver 14, and a source driver 16. The pixel matrix 12 comprises a plurality of subpixels standing for three primary colors—red (R), green (G), and blue (B). For example, a pixel matrix 12 with a resolution of 1024×768 comprises 1024×768×3 subpixels. The gate driver 14 outputs gate signals through gate lines G1-Gn to cause pixels in each row to be turned on orderly. Meanwhile, the source driver 16 outputs a corresponding data signal to pixels in each row through data lines D1-Dm, so that the pixels in each row can obtain their individually required display voltage at full charge to show various gray levels. All of the pixels of the pixel matrix 12 complete being charged based on this sequence. Afterwards, the pixels in the first row start to be charged again.

In a traditional gate driving technology, each of the subpixels is electrically connected to a data line and a gate line. But currently, the traditional gate driving technology is replaced by a 2G-hD technology in applications because a source driver is more expensive than a gate driver. Technically speaking, the 2G-hD technology is that a subpixel requires two gate lines and one half data line. But the 2G-hD technology needs to use bridge lines to implement dot inversion. Take transistors T1-T4 which the pixels correspond to for example. Due to the intersection of bridge lines, parasitic capacitances are induced or even other parasitic effects occur in the vicinity of the transistors T2 and T3, as shown in FIG. 1.

On the other hand, a user may view different gray levels images on a traditional LCD monitor depending on his/her viewing angles. For instance, a user will see whiter gray level images on the LCD monitor if he/she views images at a slanted angle (e.g., 60 degrees) compared with viewing the images at a right angle (i.e., 90 degrees). That different gray levels are shown owing to different viewing angles is called a color shift phenomenon. The color shift phenomenon is more obvious when watching a large-sized LCD. A common used method for improving the impact of the color shift phenomenon is that each of the pixels is divided into two subpixels. One of the subpixels shows higher (brighter) gray level, and the other shows lower (darker) gray level. When a user sees a superposition of colors of the two subpixels at different angles, he/she will not have obvious visual distinctions. Traditionally, there are two methods for controlling the two subpixels to display brightness and darkness, respectively. One method is adopting capacitor coupling, and the other method is to adjust signals from common voltage VCOM, gate lines and on data lines. A disadvantage of the former method is that the voltage difference between the two subpixels is constant, so color shift cannot be effectively lowered. A disadvantage of the latter method is that the method needs to adopt specially designed a common voltage generator, a gate driver, and a source driver, and increasing extra cost. Therefore, it is required for the industry to control the two subpixels with ideal voltage to precisely show the subpixel in brightness and the subpixel in darkness, to reduce the effect of parasitic capacitances induced by bridge lines, and to implement dot inversion in pixel arrangements.

SUMMARY OF THE INVENTION

It is therefore an objective of the present invention is to provide a liquid crystal display comprising a plurality of scan lines and a plurality of data line. Every two neighboring scan lines comprises a first scan line and a second scan line, and every two neighboring data lines comprises a first data line and a second data line. The liquid crystal display further comprises a plurality of pixel groups. At least a pixel group is surrounded by the first scan line, the second scan line, the first data line, and the second data line. Each pixel group comprises a first transistor, a first subpixel, a second transistor, a second subpixel, a third transistor, a third subpixel, a fourth transistor, and a fourth subpixel. The first transistor is electrically connected with the first scan line and the first data line. The second transistor is electrically connected with the first scan line and the second data line. The third transistor is electrically connected with the second scan line and the first data line. The fourth transistor is electrically connected with the second scan line and the second data line.

In one aspect of the present invention, when the first scan line delivers the scan signal to turn on the first transistor and the second transistor, the first subpixel and the second subpixel display gray levels based on data signals with opposite polarities delivered by the first data line and the second data line, respectively. When the second scan line delivers the scan signal to turn on the third transistor and the fourth transistor, the third subpixel and the fourth subpixel display gray levels based on data signals with opposite polarities delivered by the first data line and the second data line, respectively.

According to the present invention, a liquid crystal display comprises a plurality of scan lines and a plurality of data line. Every two neighboring scan lines comprises a first scan line and a second scan line, and every two neighboring data lines comprises a first data line and a second data line. The liquid crystal display further comprises a plurality of pixel groups. At least a pixel group is surrounded by the first scan line, the second scan line, the first data line, and the second data line. Each pixel group comprises a first transistor, a first subpixel, a second transistor, a second subpixel, a third transistor, a third subpixel, a fourth transistor, and a fourth subpixel. The first transistor is electrically connected with the second scan line and the first data line, the second transistor is electrically connected with the second scan line and the second data line, the third transistor is electrically connected with the first scan line and the first data line, and the fourth transistor is electrically connected with the first scan line and the second data line. When the first scan line delivers the scan signal to turn on the third transistor and the fourth transistor, the third subpixel and the fourth subpixel display gray levels based on data signals with opposite polarities delivered by the first data line and the second data line, respectively. When the second scan line delivers the scan signal to turn on the first transistor and the second transistor, the first subpixel and the second subpixel display gray levels based on data signals with opposite polarities delivered by the first data line and the second data line, respectively.

According to the present invention, a liquid crystal display comprises a plurality of scan lines and a plurality of data line.

Every two neighboring scan lines comprises a first scan line and a second scan line, and every four neighboring data lines comprises a first data line, a second data line, a third data line, and a fourth data line. The liquid crystal display further comprises a plurality of first pixel groups and a plurality of second pixel groups. Each first pixel group comprises a first transistor, a first subpixel, a second transistor, a second subpixel, a third transistor, a third subpixel, a fourth transistor, and a fourth subpixel. The first transistor is electrically connected with the second scan line and the first data line, the second transistor is electrically connected with the second scan line and the second data line, the third transistor is electrically connected with the first scan line and the first data line, and the fourth transistor is electrically connected with the first scan line and the second data line. When the first scan line delivers the scan signal to turn on the third transistor and the fourth transistor, the third subpixel and the fourth subpixel display gray levels based on data signals with opposite polarities delivered by the first data line and the second data line, respectively. When the second scan line delivers the scan signal to turn on the first transistor and the second transistor, the first subpixel and the second subpixel display gray levels based on data signals with opposite polarities delivered by the first data line and the second data line, respectively. At least a second pixel group is surrounded by the first scan line, the second scan line, the third data line, and the fourth data line. Each pixel group comprises a fifth transistor, a fifth subpixel, a sixth transistor, a sixth subpixel, a seventh transistor, a seventh subpixel, an eighth transistor, and a eighth subpixel. The fifth transistor is electrically connected with the first scan line and the third data line. The sixth transistor is electrically connected with the first scan line and the fourth data line. The seventh transistor is electrically connected with the second scan line and the third data line. The eighth transistor is electrically connected with the second scan line and the fourth data line. When the first scan line delivers a scan signal to turn on the third, the fourth, the fifth, and the sixth transistors, the third, the fourth, the fifth, and the sixth subpixels display gray levels based on data signals delivered by the first, the second, the third, and the fourth data lines, respectively. When the second scan line delivers a scan signal to turn on the first, the second, the seventh, and the eighth transistors, the first, the second, the seventh, and the eighth subpixels display gray levels based on data signals delivered by the first, the second, the third, and the fourth data lines, respectively.

In one aspect of the present invention, a polarity of the data signal for the third and the fifth subpixels from the first and the third data lines is different from that for the fourth and the sixth subpixels from the second and the fourth data lines; a polarity of the data signal for the first and the seventh subpixels from the first and the third data lines is different from that for the two and the eighth subpixels from the second and the fourth data lines.

In contrast to prior art where each of the pixel groups between two data lines and two gate lines comprises two subpixels only, in the present invention each of the pixel groups between two data lines and two gate lines comprises four subpixels. So the LCD provided by the present invention only uses half of the data lines used in the prior art. And the present inventive LCD has a function of dot inversion without using bridge line, so parasitic capacitances resulted from the arrangement of bridges can be prevented. In addition, each pixel unit of the pixel matrix comprises two subpixels, one of which shows a bright gray level and the other of which shows a dark gray level. Thus, the pixel matrix provided by the present invention can improve the color shift phenomenon.

These and other objects of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENTS

Figure 1:
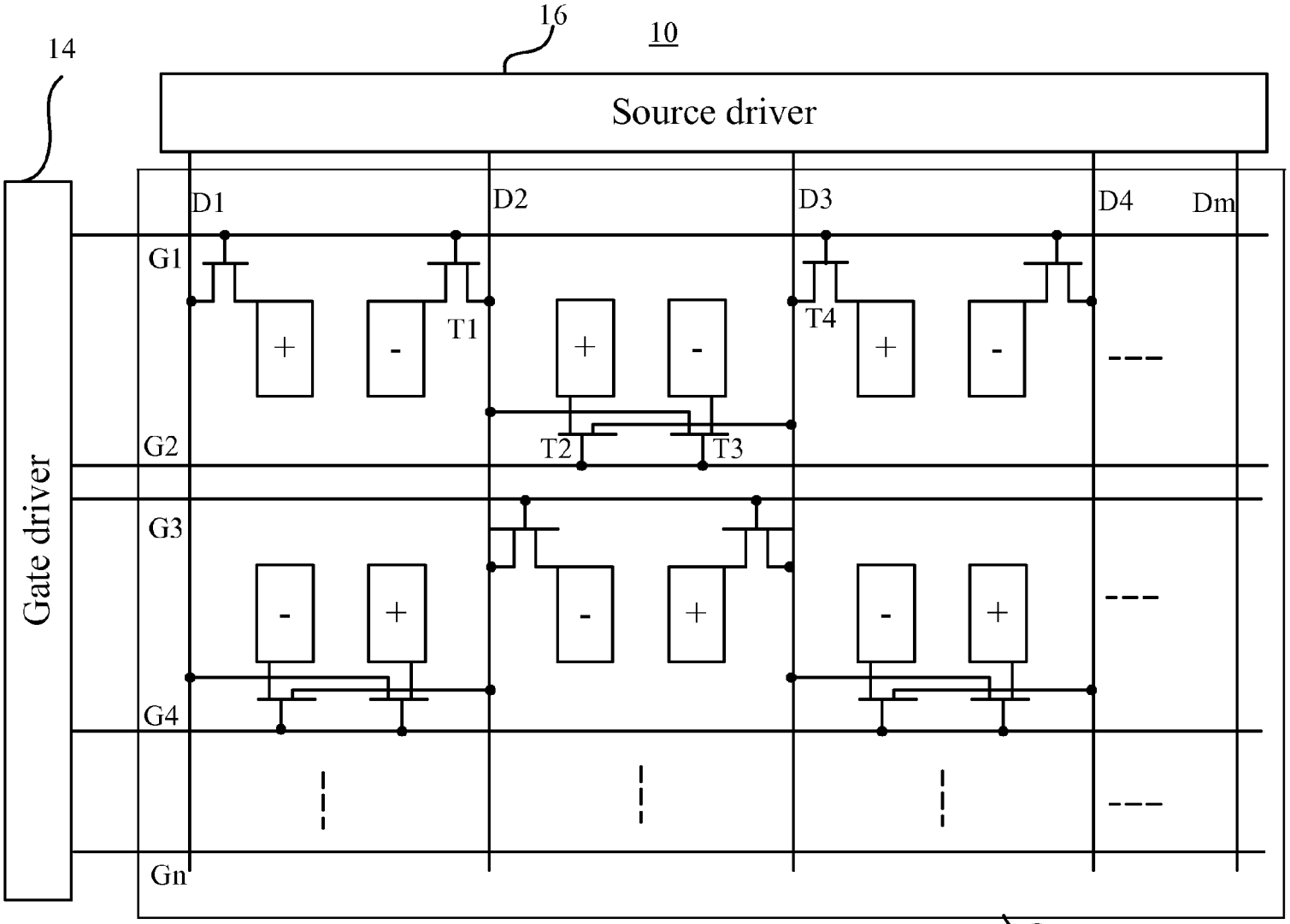
Fig. 1 (Prior art)
FIG. 1 shows a schematic diagram of a traditional LCD applying a half source driver (HSD) technology.
Figure 2:
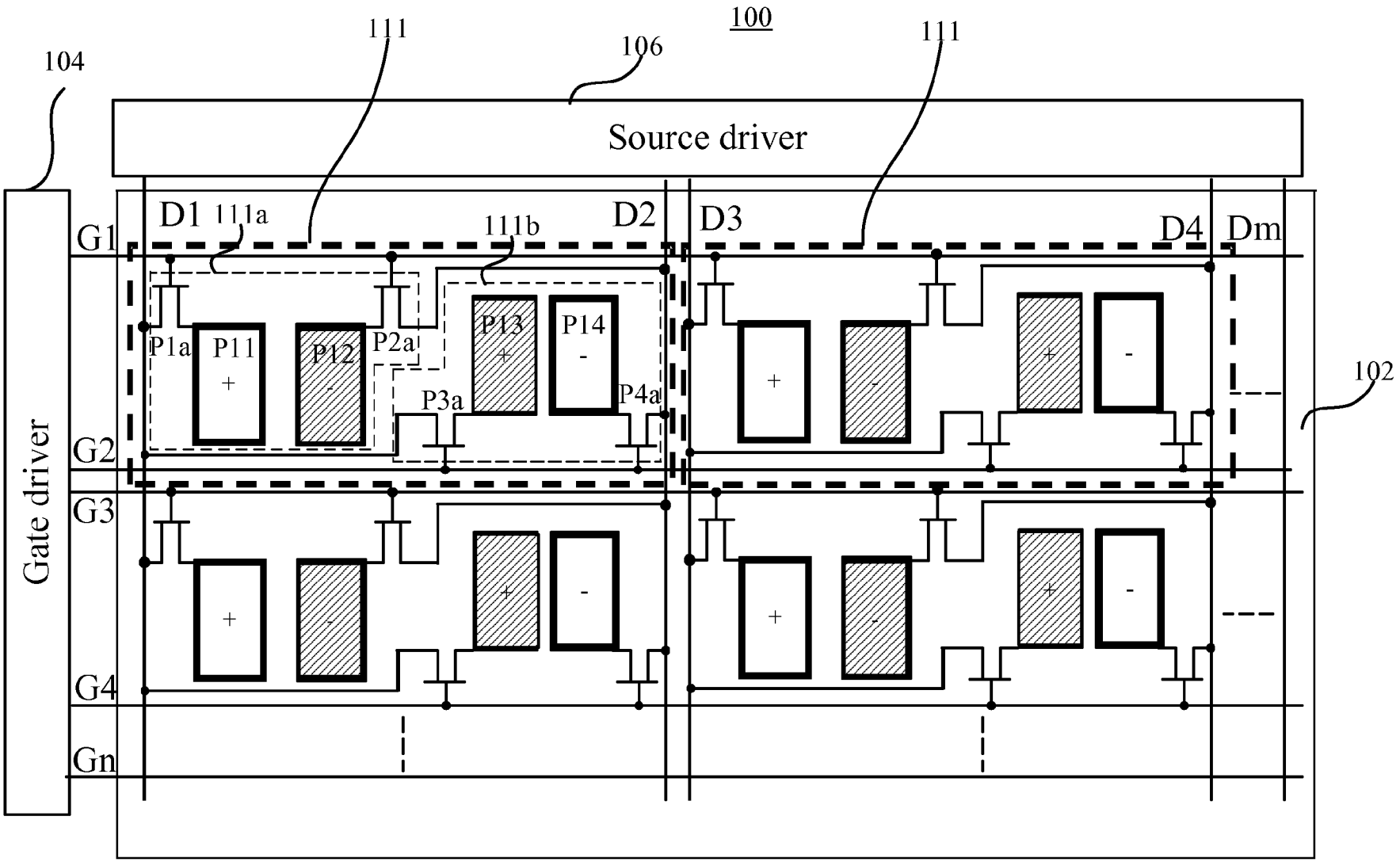
FIG. 2 is a schematic diagram illustrating a gate driver, a source driver, and a pixel matrix of an LCD according to a first embodiment of the present invention.

Refer to FIG. 2, which is a schematic diagram illustrating a gate driver 104, a source driver 106, and a pixel matrix 102 of an LCD 100 according to a first embodiment of the present invention. The LCD 100 comprises the pixel matrix 102, the gate driver 104, and the source driver 106. The pixel matrix 102 comprises a plurality of pixel groups 111. Each of the pixel groups 111 comprises a first pixel unit 111*a* and a second pixel unit 111*b*. The gate driver 104 outputs a scan signal through gate lines G1-Gn to cause pixel units in each row to be turned on orderly. Meanwhile, the source driver 106 outputs a corresponding data signal to pixels in each row through data lines D1-Dm. The pixels in each row obtain their individually required display voltage at full charge to show various gray levels. According to this embodiment, subpixels of the pixel matrix 102 are driven by adopting a half-source-driver (HSD) technology.

To simplify illustration, only a number of the pixel groups 111 on the pixel matrix 102 are selected for illustration in this embodiment. The pixel matrix 102 comprises a first gate line G1, a second gate line G2, a first data line D1, and a second data line D2. The first gate line G1 and the second gate line G2 are adjacent and are arranged in parallel. The first data line D1 and the second data line D2 are adjacent and intersect the first gate line G1 and the second gate line G2. Take a pixel group 111 among the first gate line G1, the second gate line G2, the first data line D1, and the second data line D2 for example, the first pixel unit 111*a* comprises a first subpixel P11 and a second subpixel P12. The second pixel unit 111*b* comprises a third subpixel P13 and a fourth subpixel P14.

The first subpixel P11 comprises a first transistor P1*a* electrically connected with the first gate line G1 and the first data line D1. The second subpixel P12 comprises a second transistor P2*a* electrically connected with the first gate line G1 and the second data line D2. The third subpixel P13 comprises a third transistor P3*a* electrically connected with the second gate line G2 and the first data line D1. The fourth subpixel P14 comprises a fourth transistor P4*a* electrically connected with the second gate line G2 and the second data line D2.

At first, the gate driver 104 transmits a gate signal through the first gate line G1 to cause the transistors P1*a* and P2*a* of the pixel group 111 to be turned on. In the meantime, the source driver 106 transmits data signals with opposite polarities through the first data line D1 and the second data line D2, respectively, and then through the turned on transistors P1*a* and P2*a* to the first subpixel P11 and the second subpixel P12. Meanwhile, the first subpixel P11 and the second subpixel P12 show a first gray level and a second gray level according to the data signals with opposite polarities. Because the first gray level is different from the second gray level, the first subpixel P11 and the second subpixel P12 show brightness and darkness, respectively. For instance, the first subpixel P11 appears in a bright red color while the second subpixel P12 appears in a dark red color. In human visual perception, a user can observe the averaged gray level effect of the mixed first gray level and the second gray level. Next, the gate driver 104 transmits another gate signal through the second gate line G2 to cause the transistors P3*a* and P4*a* to be turned on. In the meantime, the source driver 106 transmits data signals with opposite polarities through the first data line D1 and the second data line D2, respectively, and then through the turned on transistors P3*a* and P4*a* to the third subpixel P13 and the fourth subpixel P14. Meanwhile, the third subpixel P13 and the fourth subpixel P14 display a third gray level and a fourth gray level according to the data signals with opposite polarities. Because the third gray level is different from the fourth gray level, the third subpixel P13 and the fourth subpixel P14 display brightness and darkness, respectively. In human visual perception, a user can observe the averaged gray level effect of the mixed third gray level and the fourth gray level. Next, the gate driver 104 transmits gate signals through the third gate line G3 orderly, causing the pixel group 111 in the next row to operate according to the above-mentioned mechanism. After all of the pixels of the pixel matrix 102 complete being charged, the pixels in the first row start to be charged again for the next frame.

Figure 3:
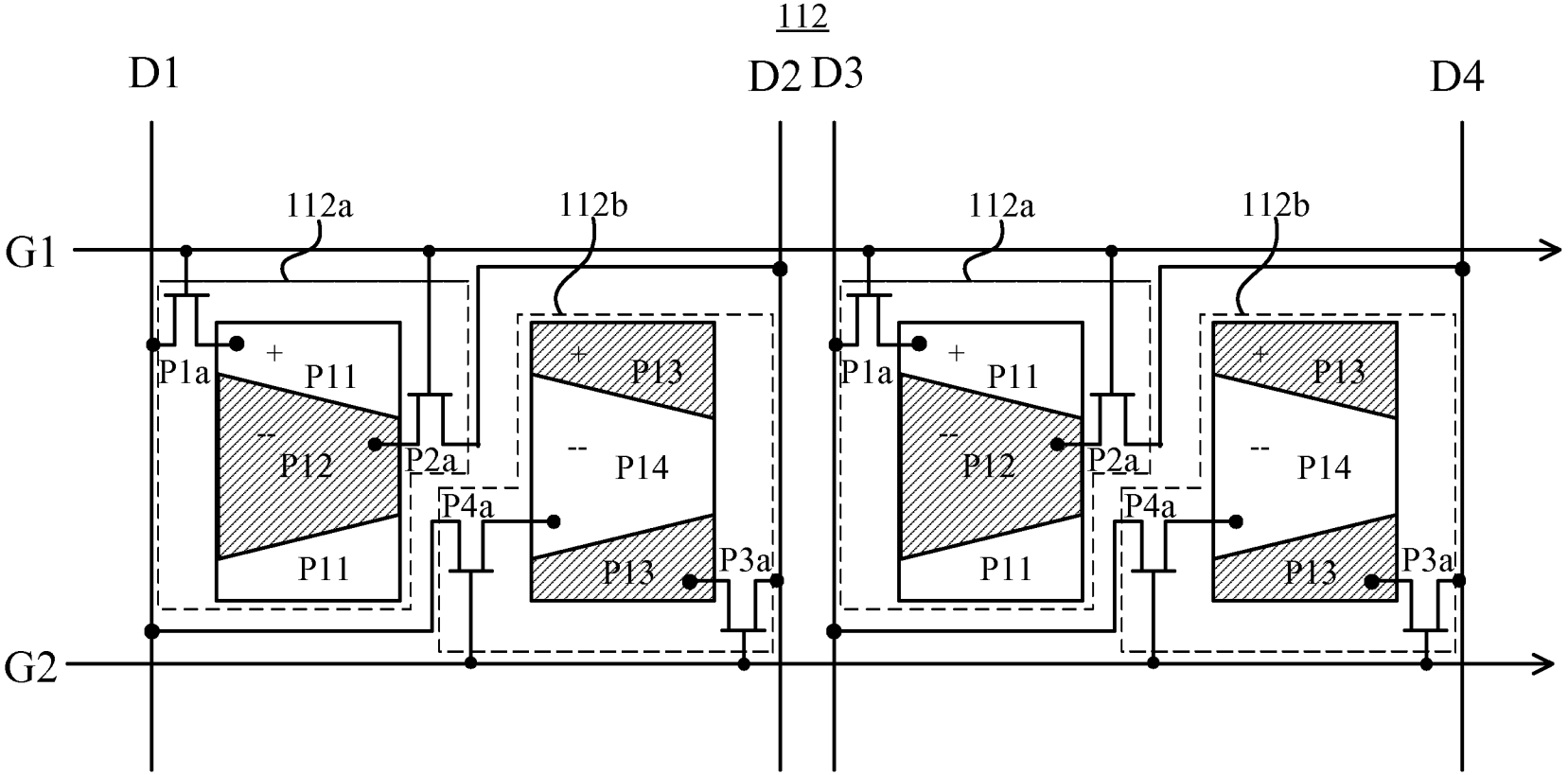
FIG. 3 is a schematic diagram illustrating a pixel matrix according to a second embodiment of the present invention.

Refer to FIG. 3, which is a schematic diagram illustrating a pixel matrix 112 according to a second embodiment of the present invention. To simplify the illustration, the gate driver 104 and the source driver 106 of the LCD 100 are not illustrated hereafter. The gate driver 104 and the source driver 106 have the same functions and operations as those have in the second embodiment, so no more details are provided herein. In FIG. 3, the pixel matrix 112 comprises a first pixel unit 112*a* and a second pixel unit 112*b*. The first pixel unit 112*a* comprises a first subpixel P11 and a second subpixel P12. The second pixel unit 112*b* comprises a third subpixel P13 and a fourth subpixel P14. Connectivity relations between the pixel matrix 112 and the data lines D1-Dm and the gate lines G1-Gn shown in FIG. 3 are the same as connectivity relations between the pixel group 111 and the data lines D1-Dm and the gate lines G1-Gn shown in FIG. 2, so no details are provided herein. Preferably, the combined area of the first subpixel P11 and the second subpixel P12 is a complementary rectangle in shape. The combined area of the third subpixel P13 and the fourth subpixel P14 is also a complementary rectangle in shape. It is notified that, the first subpixel P11, the second subpixel P12, the third subpixel P13, or the fourth subpixel P14 is not restricted to be rectangular; instead, all of the subpixels P11, P12, P13, and P14 can be triangular, polygonal, or other arbitrarily or irregularly shaped. Similarly, the combined area of the first subpixel P11 and the second subpixel P12 or the combined area of the third subpixel P13 and the fourth subpixel P14 is not restricted to be rectangular; instead, both of them can be triangular, polygonal, or arbitrarily or other irregularly shaped. Each of the subpixels P11, P12, P13, and P14 can have the same or different area.

Figure 4:
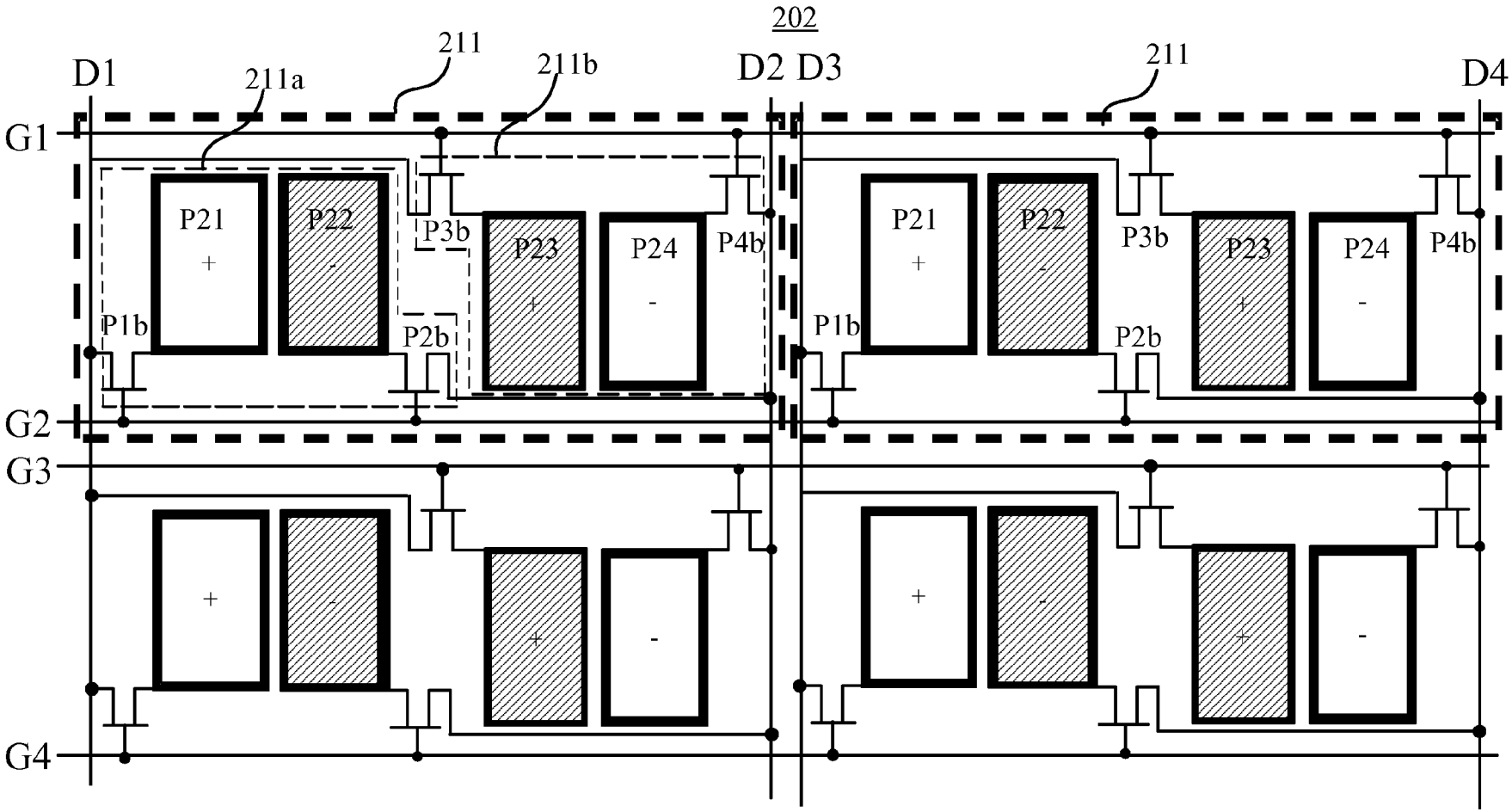
FIG. 4 is a schematic diagram illustrating a pixel matrix according to a third embodiment of the present invention.

Please refer to FIG. 4, which is a schematic diagram illustrating a pixel matrix 202 according to a third embodiment of the present invention. The pixel matrix 202 comprises a plurality of pixel groups 211. Take a pixel groups 211 surrounded by a first gate line G1, a second gate line G2, a first data line D1, and a second data line D2 for example, the pixel group 211 comprises a first pixel unit 211*a* and a second pixel unit 211*b*. The first pixel unit 211*a* comprises a first subpixel P21 and a second subpixel P22. The second pixel unit 211*b* comprises a third subpixel P23 and a fourth subpixel P24.

The first subpixel P21 comprises a first transistor P1*b* electrically connected with the second gate line G2 and the first data line D1. The second subpixel P22 comprises a second transistor P2*b* electrically connected with the second gate line G2 and the second data line D2. The third subpixel P23 comprises a third transistor P3*b* electrically connected with the first gate line G1 and the first data line D1. The fourth subpixel P24 comprises a fourth transistor P4*b* electrically connected with the first gate line G1 and the second data line D2.

When the first gate line G1 transmits a gate signal to cause the transistors P3*b* and P4*b* of the pixel group 211 to be turned on, the first data line D1 and the second data line D2 deliver data signals with opposite polarities to the third subpixel P23 and the fourth subpixel P24 through the turned-on transistors P3*b* and P4*b*, respectively. The third subpixel P23 and the fourth subpixel P24 show a third gray level and a fourth gray level according to the data signals with opposite polarities. Because the third gray level is different from the fourth gray level, the third subpixel P23 and the fourth subpixel P24 show brightness and darkness, respectively. In human visual perception, a user can observe the averaged gray level effect of the mixed third gray level and the fourth gray level.

Next, the second gate line G2 transmits a gate signal to cause the transistors P1*b* and P2*b* of the pixel group 211 to be turned on, the first data line D1 and the second data line D2 deliver data signals with opposite polarities to the first subpixel P21 and the second subpixel P22 through the turned-on transistors P1*b* and P2*b*, respectively. The first subpixel P21 and the second subpixel P22 show a first gray level and a second gray level according to the data signals with opposite polarities. Because the first gray level is different from the second gray level, the first subpixel P21 and the second subpixel P22 show brightness and darkness (or darkness and brightness), respectively. In human visual perception, a user can observe the averaged gray level effect of the mixed first gray level and the second gray level. Next, the gate line G3 delivers another scan signal to the pixel groups on the next row to be operated according to the above-mentioned mechanism. After all of the pixels of the pixel matrix 202 complete being charged, the pixels in the first row start to be charged again for the next frame.

Figure 5:
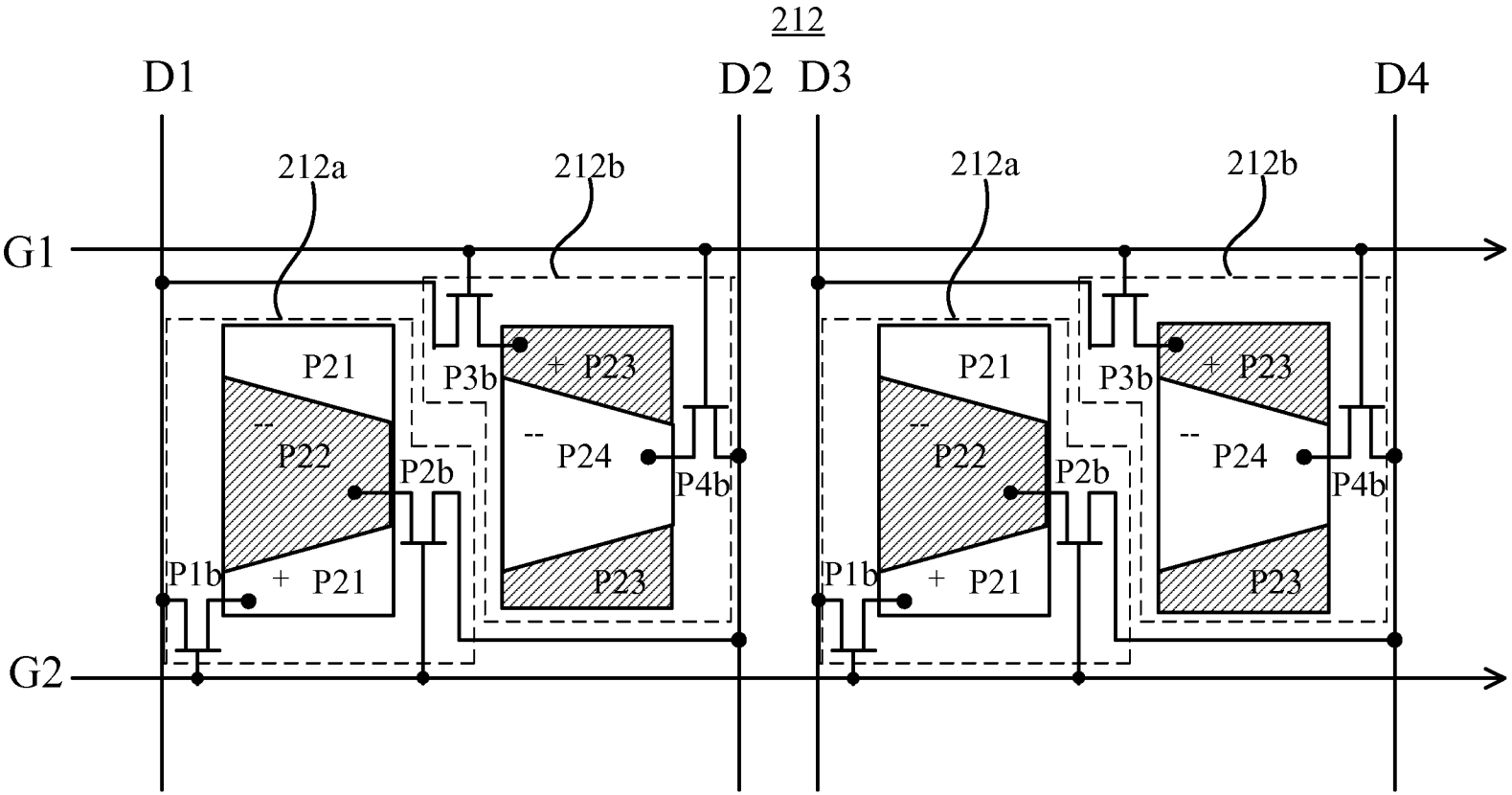
FIG. 5 is a schematic diagram illustrating a pixel matrix 212 according to a fourth embodiment of the present invention.

With reference to FIG. 5, which is a schematic diagram illustrating a pixel matrix 212 according to a fourth embodiment of the present invention. The pixel matrix 212 comprises a first pixel unit 212*a* and a second pixel unit 212*b*. The first pixel unit 212*a* comprises a first subpixel P21 and a second subpixel P22. The second pixel unit 212*b* comprises a third subpixel P23 and a fourth subpixel P24. Connectivity relations between the pixel matrix 212 and the data lines D1-D4 and the gate lines G1-G2 shown in FIG. 5 are the same as connectivity relations between the pixel group 211 and the data lines D1-D4 and the gate lines G1-G2 shown in FIG. 4, so no details are provided herein. Preferably, the combined area of the first subpixel P21 and the second subpixel P22 is a complementary rectangle in shape. The combined area of the third subpixel P23 and the fourth subpixel P24 is also a complementary rectangle in shape. It is notified that, the first subpixel P21, the second subpixel P22, the third subpixel P23, or the fourth subpixel P24 is not restricted to be rectangular; instead, all of the subpixels P21, P22, P23, and P24 can be triangular, polygonal, or other arbitrarily or irregularly shaped. Similarly, the combined area of the first subpixel P21 and the second subpixel P22 or the combined area of the third subpixel P23 and the fourth subpixel P24 is not restricted to be rectangular; instead, both of them can be triangular, polygonal, or other arbitrarily or irregularly shaped. Each of the subpixels P21, P22, P23, and P24 can have the same or different area.

Figure 6:
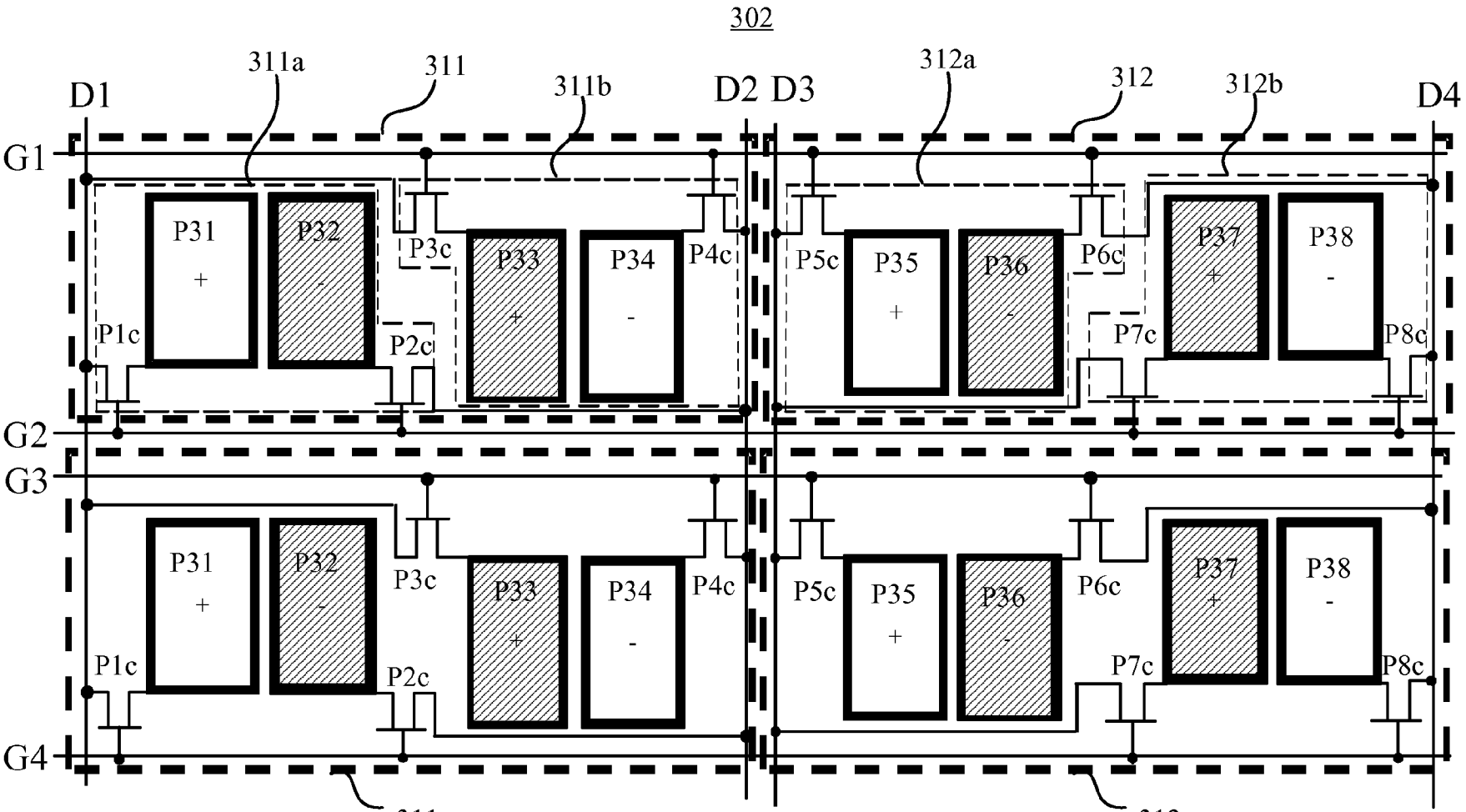
FIG. 6 is a schematic diagram illustrating a pixel matrix according to a fifth embodiment of the present invention.

Please refer to FIG. 6, which is a schematic diagram illustrating a pixel matrix 302 according to a fifth embodiment of the present invention. The pixel matrix 302 comprises a plurality of first pixel groups 311 and a plurality of second pixel groups 312. One of the first pixel groups 311 surrounded by a first gate line G1, a second gate line G2, a first data line D1, and a second data line D2. The first pixel group 311 comprises a first pixel unit 311*a* and a second pixel unit 311*b*. The first pixel unit 311*a* comprises a first subpixel P31 and a second subpixel P32. The second pixel unit 311*b* comprises a third subpixel P33 and a fourth subpixel P34. One of the second pixel groups 312 is surrounded by a first gate line G2, a second gate line G2, a third data line D3, and a fourth data line D4. The second pixel group 312 comprises a third pixel unit 312*a* and a fourth pixel unit 312*b*. The third pixel unit 312*a* comprises a fifth subpixel P35 and a sixth subpixel P36. The fourth pixel unit 312*b* comprises a seventh subpixel P37 and an eighth subpixel P38.

The pixel group 311 comprises a first transistor P1*c* electrically connected with the second gate line G2 and the first data line D1, a second transistor P2*c* of the pixel group 311 electrically connected with the second gate line G2 and the second data line D2, a third transistor P3*c* of the pixel group 311 electrically connected with the first gate line G1 and the first data line D1, and a fourth transistor P4*c* of the pixel group 311 electrically connected with the first gate line G1 and the second data line D2.

The pixel group 312 comprises a fifth transistor P5*c* electrically connected with the first gate line G1 and the third data line D3, a sixth transistor P6*c* electrically connected with the first gate line G1 and the fourth data line D4, a seventh transistor P7*c* electrically connected with the second gate line G2 and the third data line D3, and an eighth transistor P8*c* electrically connected with the second gate line G2 and the fourth data line D4.

At first, the first gate line G1 transmits a gate signal to cause the transistors P3*c* and P4*c* of the pixel group 311 and the transistors P5*c* and P6*c* of the pixel group 312 to be turned on. In the meantime, the data lines D1 and D3 transmit data signals with a positive polarity to the third subpixel P33 and the fifth subpixel P35 through the turned-on transistors P3*c* and P5*c*, respectively, and the data lines D2 and D4 transmit data signals with a negative polarity to the fourth subpixel P34 and the sixth subpixel P36 through the turned-on transistors P4*c* and P6*c*, respectively. Therefore, the third subpixel P33 and the fifth subpixel P35 show a third gray level and a fifth gray level according to the data signals with the positive polarity, while the fourth subpixel P34 and the sixth subpixel P36 show a fourth gray level and a sixth gray level according to the data signals with the negative polarity. Because the third gray level is different from the fourth gray level, the third subpixel P33 and the fourth subpixel P34 show brightness and darkness, respectively; the fifth gray level is different from the sixth gray level, the fifth subpixel P35 and the sixth subpixel P36 show brightness and darkness, respectively. In human visual perception, a user can observe the averaged gray level effect of the mixed third gray level of the third subpixel P33 and the fourth gray level of the fourth subpixel P34, and can also observe the averaged gray level effect of the mixed fifth gray level of the fifth subpixel P35 and the sixth gray level of the sixth subpixel P36.

Next, the second gate line G2 transmits a gate signal to cause the transistors P1*c* and P2*c* of the pixel group 311 and the transistors P7*c* and P8*c* of the pixel group 312 to be turned on. In the meantime, the data lines D1 and D3 transmit data signals with a positive polarity to the first subpixel P31 and the seventh subpixel P37 through the turned-on transistors P1*c* and P7*c*, respectively, and the data lines D2 and D4 transmit data signals with a negative polarity to the second subpixel P32 and the eighth subpixel P38 through the turned-on transistors P2*c* and P8*c*, respectively. Therefore, the first subpixel P31 and the seventh subpixel P37 show a first gray level and a seventh gray level according to the data signals with the positive polarity, while the second subpixel P32 and the eighth subpixel P38 show a second gray level and an eighth gray level according to the data signals with the negative polarity. Because the first gray level is different from the second gray level, the first subpixel P31 and the second subpixel P32 show brightness and darkness, respectively; the seventh gray level is different from the eighth gray level, the seventh subpixel P37 and the eighth subpixel P38 show brightness and darkness, respectively. In human visual perception, a user can observe the averaged gray level effect of the mixed first gray level of the first subpixel P31 and the second gray level of the second subpixel P32, and can also observe the averaged gray level effect of the mixed seventh gray level of the seventh subpixel P37 and the eighth gray level of the eighth subpixel P38. Next, the gate line G3 delivers another scan signal to the pixel groups 311, 312 on the next row to be operated according to the above-mentioned mechanism. After all of the pixels of the pixel matrix 302 complete being charged, the pixels in the first row start to be charged again for the next frame.

It is noted that the opposite polarities of the data signals delivered by the data lines D1, D2 alternatively change during two-frame time periods. For example, during the first frame time period, the data line D1, D3 deliver data signals with a positive polarity, and the data line D2, D4 deliver data signals with a negative polarity; during the next frame time period, the data line D1, D3 deliver data signals with the negative polarity, and the data line D2, D4 deliver data signals with the positive polarity. In this way, the purpose of dot inversion is realized.

Figure 7:
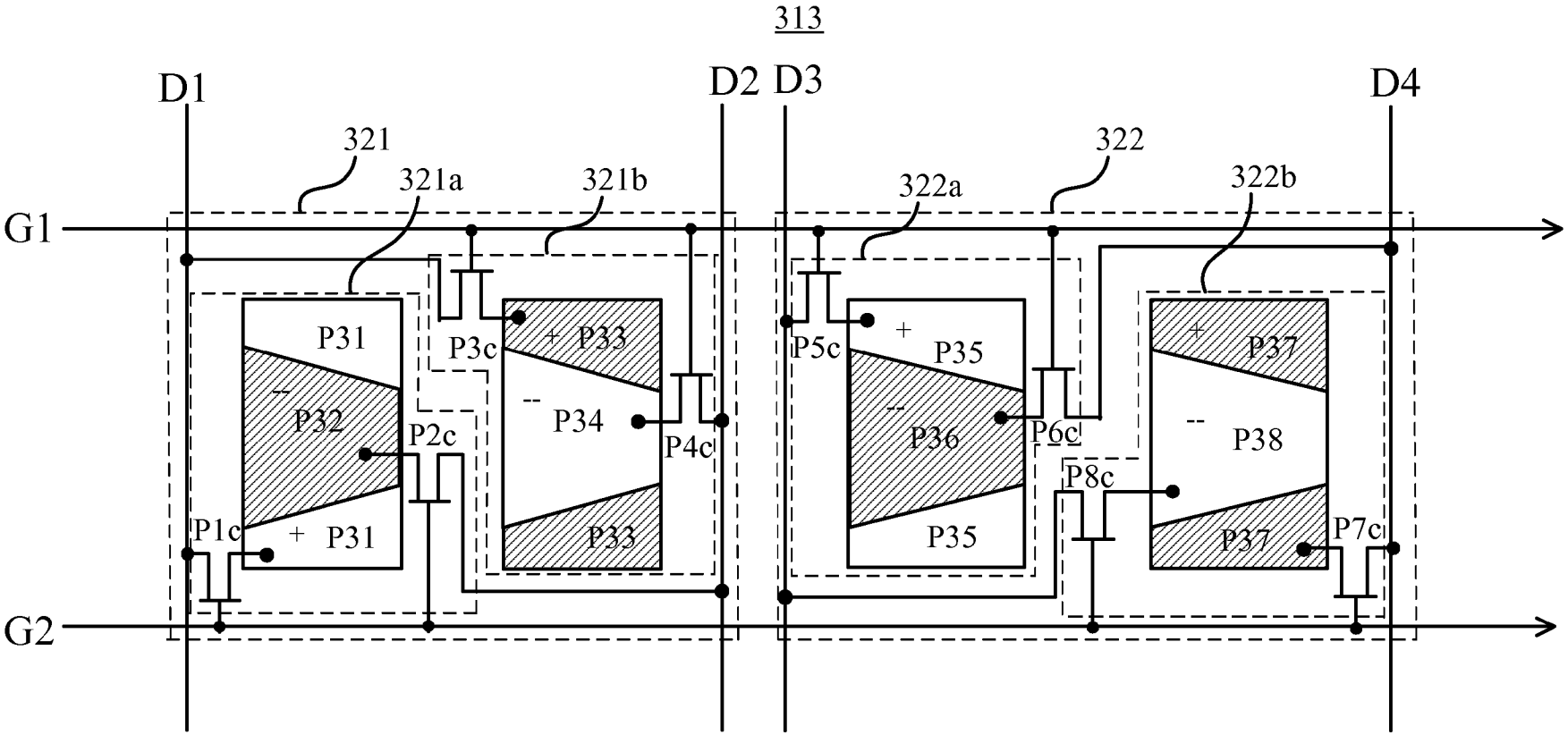
FIG. 7 is a schematic diagram illustrating a pixel matrix according to a sixth embodiment of the present invention.

With reference to FIG. 7, which is a schematic diagram illustrating a pixel matrix 313 according to a sixth embodiment of the present invention. The pixel matrix 313 comprises a plurality of first pixel groups 321 and a plurality of second pixel groups 322. The second pixel groups 322 surrounded by a first gate line G2, a second gate line G2, a first data line D1, and a second data line D2. The first pixel group 321 comprises a first pixel unit 321*a* and a second pixel unit 321*b*. The first pixel unit 321*a* comprises a first subpixel P31 and a second subpixel P32. The second pixel unit 321*b* comprises a third subpixel P33 and a fourth subpixel P34. The pixel groups 322 surrounded by a first gate line G2, a second gate line G2, a third data line D3, and a fourth data line D4. The second pixel group 322 comprises a third pixel unit 322*a* and a fourth pixel unit 322*b*. The third pixel unit 322*a* comprises a fifth subpixel P35 and a sixth subpixel P36. The fourth pixel unit 322*b* comprises a seventh subpixel P37 and an eighth subpixel P38.

Connectivity relations between the pixel groups 321, 322 and the data lines D1-D4 and the gate lines G1-G2 shown in FIG. 7 are the same as connectivity relations between the pixel groups 311, 312 and the data lines D1-D4 and the gate lines G1-G2 shown in FIG. 6, so no details are provided herein. Preferably, the combined area of the first subpixel P31 and the second subpixel P32, the combined area of the third subpixel P33 and the fourth subpixel P34, the combined area of the fifth subpixel P35 and the sixth subpixel P36, and the combined area of the seventh subpixel P37 and the eighth subpixel P38 are all complementary rectangle in shape. It is notified that, any of the subpixels P31-P38 is not restricted to be rectangular in area; instead, all of the subpixels P31-P38 can be triangular, polygonal, or other arbitrarily or irregularly shaped. Similarly, the combined area of the subpixels P31 and P32, the combined area of the subpixels P33 and P34, the combined area of the subpixels P35 and P36, or the combined area of the subpixels P37 and P38 are not restricted to be rectangular; instead, all of them can be triangular, polygonal, or other arbitrarily or irregularly shaped. Each of the subpixels P31-P38 can have the same or different area.

In contrast to the pixel matrix of the prior art where only two subpixels are arranged in each of the pixel groups among two data lines and two gate lines, for the present invention four subpixels P11-P14, P21-P24, P31-P34 are arranged in each of the pixel groups among two data lines D1 and D2 and two gate lines G1 and G2. So the LCD of the present invention only uses half of the data lines that are used in the prior art. Moreover, each of the subpixels has a function of dot inversion without using bridge lines to connect data lines, so no additional parasitic capacitances resulting from the intersection of the bridges will occur. In addition, the pixel unit of the pixel matrix comprises two subpixels displaying two different gray levels (i.e., brightness and darkness), respectively, so the pixel matrix of the present invention can improve color shift.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

What is claimed is:

1. A liquid crystal display comprising a plurality of scan lines and a plurality of data line, every two neighboring scan lines comprising a first scan line and a second scan line, every two neighboring data lines comprising a first data line and a second data line, characterized in that the liquid crystal display further comprises:

a plurality of pixel groups, at least a pixel group surrounded by the first scan line, the second scan line, the first data line, and the second data line, and each pixel group comprising a first transistor, a first subpixel, a second transistor, a second subpixel, a third transistor, a third subpixel, a fourth transistor, and a fourth subpixel, the first transistor being electrically connected with the first scan line and the first data line, the second transistor being electrically connected with the first scan line and the second data line, the third transistor being electrically connected with the second scan line and the first data line, and the fourth transistor being electrically connected with the second scan line and the second data line.

2. The liquid crystal display of claim 1, characterized in that:

when the first scan line delivers a scan signal to turn on the first transistor and the second transistor, the first subpixel and the second subpixel display gray levels based on data signals delivered by the first data line and the second data line, respectively;

when the second scan line delivers a scan signal to turn on the third transistor and the fourth transistor, the third subpixel and the fourth subpixel display gray levels based on data signals delivered by the first data line and the second data line, respectively.

3. The liquid crystal display of claim 2, characterized in that:

when the first scan line delivers the scan signal to turn on the first transistor and the second transistor, the first subpixel and the second subpixel display gray levels based on data signals with opposite polarities delivered by the first data line and the second data line, respectively;

when the second scan line delivers the scan signal to turn on the third transistor and the fourth transistor, the third subpixel and the fourth subpixel display gray levels based on data signals with opposite polarities delivered by the first data line and the second data line, respectively.

4. A liquid crystal display comprising a plurality of scan lines and a plurality of data line, every two neighboring scan lines comprising a first scan line and a second scan line, every two neighboring data lines comprising a first data line and a second data line, characterized in that the liquid crystal display further comprises:

a plurality of pixel groups, at least a pixel group surrounded by the first scan line, the second scan line, the first data line, and the second data line, and each pixel group comprising a first transistor, a first subpixel, a second transistor, a second subpixel, a third transistor, a third subpixel, a fourth transistor, and a fourth subpixel, the first transistor being electrically connected with the second scan line and the first data line, the second transistor being electrically connected with the second scan line and the second data line, the third transistor being electrically connected with the first scan line and the first data line, and the fourth transistor being electrically connected with the first scan line and the second data line.

5. The liquid crystal display of claim 4, characterized in that:

when the first scan line delivers a scan signal to turn on the third transistor and the fourth transistor, the third subpixel and the fourth subpixel display gray levels based on data signals delivered by the first data line and the second data line, respectively;

when the second scan line delivers a scan signal to turn on the first transistor and the second transistor, the first subpixel and the second subpixel display gray levels based on data signals which are delivered by the first data line and the second data line, respectively.

6. The liquid crystal display of claim 5, characterized in that:

when the first scan line delivers the scan signal to turn on the third transistor and the fourth transistor, the third subpixel and the fourth subpixel display gray levels based on data signals with opposite polarities delivered by the first data line and the second data line, respectively;

when the second scan line delivers the scan signal to turn on the first transistor and the second transistor, the first subpixel and the second subpixel display gray levels based on data signals with opposite polarities delivered by the first data line and the second data line, respectively.

7. A liquid crystal display comprising a plurality of scan lines and a plurality of data line, every two neighboring scan lines comprising a first scan line and a second scan line, every two neighboring data lines comprising a first data line and a second data line, characterized in that the liquid crystal display further comprises:

a plurality of pixel groups, at least a pixel group surrounded by the first scan line, the second scan line, the first data line, and the second data line, and each pixel group comprises:

a first pixel unit comprising a first transistor, a first subpixel, a second transistor, and a second subpixel, the first transistor being electrically connected with the first scan line and the first data line, the second transistor being electrically connected with the first scan line and the second data line, the first subpixel and the second subpixel display a first gray level and a second gray level based on data signals delivered by the first data line and the second data line, respectively, wherein the first gray level is different from the second gray level; and a second pixel unit comprising a third transistor, a third subpixel, a fourth transistor, and a fourth subpixel, the third transistor being electrically connected with the second scan line and the first data line, and the fourth transistor being electrically connected with the second scan line and the second data line, the third subpixel and the fourth subpixel display a third gray level and a fourth gray level based on data signals delivered by the first data line and the second data line, respectively, wherein the third gray level is different from the fourth gray level.

8. The liquid crystal display of claim 7, characterized in that:

when the first scan line delivers a scan signal to turn on the first transistor and the second transistor, the first subpixel and the second subpixel display the first gray level and the second gray level based on data signals delivered by the first data line and the second data line, respectively;

when the second scan line delivers a scan signal to turn on the third transistor and the fourth transistor, the third subpixel and the fourth subpixel display the third gray level and the fourth gray level based on data signals delivered by the first data line and the second data line, respectively.

9. The liquid crystal display of claim 8, characterized in that:

when the first scan line delivers the scan signal to turn on the first transistor and the second transistor, the first subpixel and the second subpixel display the first gray level and the second gray level based on data signals with opposite polarities delivered by the first data line and the second data line, respectively;

when the second scan line delivers the scan signal to turn on the third transistor and the fourth transistor, the third subpixel and the fourth subpixel display the third gray level and the fourth gray level based on data signals with opposite polarities delivered by the first data line and the second data line, respectively.

10. The liquid crystal display of claim 8, characterized in that the first subpixel, the second subpixel, the third subpixel, and the fourth subpixel are rectangular in shape.

11. The liquid crystal display of claim 8, characterized in that a combination of the first subpixel and the second subpixel is rectangular in shape, and a combination of the third subpixel and the fourth subpixel is rectangular in shape as well.

12. The liquid crystal display of claim 7, 8, 9, 10, or 11, characterized in that an area of the first subpixel is the same as that of the second subpixel.

13. The liquid crystal display of claim 7, 8, 9, 10, or 11, characterized in that an area of the third subpixel is the same as that of the fourth subpixel.

* * * * *